US009187882B2

(12) United States Patent
Masoud

(10) Patent No.: US 9,187,882 B2
(45) Date of Patent: Nov. 17, 2015

(54) BATHROOM WASHING APPARATUS WITH PLURAL BASINS AND INTEGRATED WATERFLOW FEATURES

(76) Inventor: Hadi Ibrahim Masoud, Ann Arbor, MI (US)

( * ) Notice: Subject to any disclaimer, the term of this patent is extended or adjusted under 35 U.S.C. 154(b) by 615 days.

(21) Appl. No.: 13/585,332

(22) Filed: Aug. 14, 2012

(65) Prior Publication Data

US 2014/0047635 A1 Feb. 20, 2014

(51) Int. Cl.

| | |
|---|---|
| ***A47K 4/00*** | (2006.01) |
| ***E03C 1/01*** | (2006.01) |
| ***A47K 3/022*** | (2006.01) |
| *A47K 10/48* | (2006.01) |

(52) U.S. Cl.

CPC . *E03C 1/01* (2013.01); *A47K 3/022* (2013.01); *A47K 4/00* (2013.01); *A47K 10/48* (2013.01)

(58) Field of Classification Search

CPC ..... E03C 1/18; E03C 1/16; E03C 2201/30; A47K 3/022; A61H 35/006

USPC ..... 4/622, 624, 638, 639, 643

See application file for complete search history.

(56) References Cited

U.S. PATENT DOCUMENTS

| | | | | |
|---|---|---|---|---|
| 1,616,313 | A * | 2/1927 | Farmer | 4/622 |
| 1,807,900 | A * | 6/1931 | Dougherty | 4/653 |

FOREIGN PATENT DOCUMENTS

| | | | |
|---|---|---|---|
| CN | 201192294 | Y | 2/2009 |
| CN | 201649190 | U | 11/2010 |
| EP | 2 431 542 | A1 | 3/2012 |
| GB | 2314015 | A | 12/1997 |
| JP | 06046966 | A * | 2/1994 |

OTHER PUBLICATIONS

Auto Wudu Washer Brochure, Islamic Pre-prayer Ablution System, AACE Technologies Sdn Bhd (765056-V), Model AWW STD.707, http//aace.com.my/aace.pdf, Received from Thomson Research Services on Mar. 12, 2012.

* cited by examiner

*Primary Examiner* — Tuan N Nguyen

(74) *Attorney, Agent, or Firm* — Oblon, McClelland, Maier & Neustadt, L.L.P.

(57) ABSTRACT

A bathroom sink with an upper basin substantially at waist level, a lower basin substantially at foot or knee level or between foot and knee levels, and a diverter that diverts a flow of water from the upper basin to the lower basin. The diverter may be next to a first faucet mounted to the first basin, on a side of the upper basin, or on a stand connecting the upper basin to the lower basin. One or more additional faucets may also be mounted to the lower basin. A pair of driers may be mounted to the lower basin. A control panel may be mounted to the upper basin so that a controller can control the flow of water based on a water meter or a timer, log water usage and/or other information in association with a user ID, and/or display an instructional video.

7 Claims, 12 Drawing Sheets

BATHROOM WASHING APPARATUS WITH PLURAL BASINS AND INTEGRATED WATERFLOW FEATURES

GRANT OF NON-EXCLUSIVE RIGHT

This application was prepared with financial support from the Saudi Arabian Cultural Mission, and in consideration therefore the present inventor has granted The Kingdom of Saudi Arabia a non-exclusive right to practice the present invention.

BACKGROUND

1. Field of the Disclosure

This disclosure relates to a bathroom sink with at least two basins, and more specifically, to a bathroom sink with at least two basins, where one basin is at foot or knee level or between foot and knee levels.

2. Description of the Related Art

The "background" description provided herein is for the purpose of generally presenting the context of the disclosure. Work of the presently named inventor, to the extent it is described in this background section, as well as aspects of the description which may not otherwise qualify as prior art at the time of filing, are neither expressly nor impliedly admitted as prior art against the present invention.

Conventional bathroom sinks are neither comfortable nor safe to be used by a user for washing their feet as a user has to lift their feet to the basin level.

SUMMARY

This disclosure relates to a bathroom sink with at least two basins, and more specifically, to a bathroom sink with at least two basins, where one basin is at foot or knee level or between foot and knee levels.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE EMBODIMENTS

Figure 1:
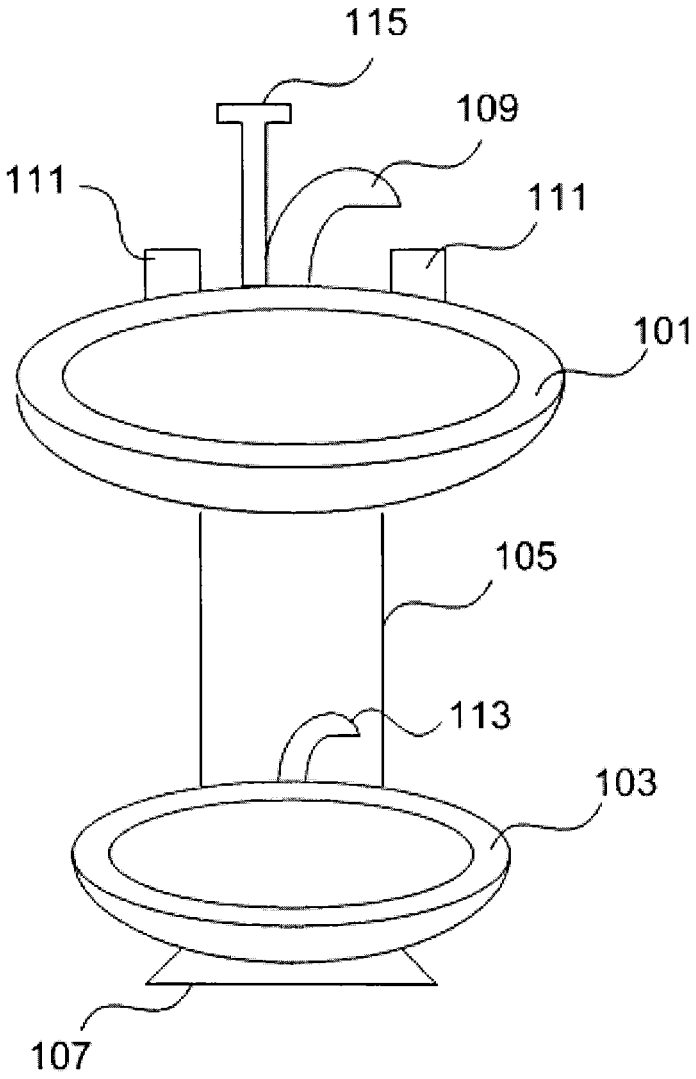
FIG. 1 is an illustrative view of an embodiment of a bathroom sink with an upper and a lower basin, and a diverter mounted on the upper basin, next to a faucet mounted on the upper basin.

Referring now to the drawings, wherein like reference numerals designate identical or corresponding parts throughout the several views, FIG. 1 is an illustrative view of a first embodiment of a bathroom sink with an upper basin 101 and a lower basin 103. The footprint of the lower basin 103 is substantially equal to or smaller than the footprint of the upper basin 101. The lower basin 103 is connected to the upper basin 101 via a stand 105. The lower basin 103 is supported by a platform 107. Alternatively, the lower basin 103 may be supported by an extension of the stand 105. The stand 105 includes a hollow portion in which water is conveyed to the lower basin 103. The upper basin 101 includes a first faucet 109 and a pair of water control valves 111. Alternatively, a single water control valve or a motion sensor may be used to control flow of water. The upper basin 101 also includes a diverter 115 mounted next to the first faucet 109. Alternatively, when the upper basin 101 includes a drainage control bar mounted behind the first faucet 109, the diverter 115 may be mounted behind or next to such drainage control bar. The lower basin 103 includes a second faucet 113. A flow of water to both the upper basin 101 and the lower basin 103 is controlled by the water control valves 111. A controllable amount of water may also be directed to both the first faucet 109 and the second faucet 113, based on a spacing of a horizontal cavity 209 in the diverter 115 (one mode) and an extended edge 207 in the diverter 115 (second mode), as will become evident from FIGS. 2A and 2B. Alternatively, the flow of water may be directed entirely to either the first faucet 109 or the second faucet 113 based on the mode of the diverter 115.

Figure 2A:
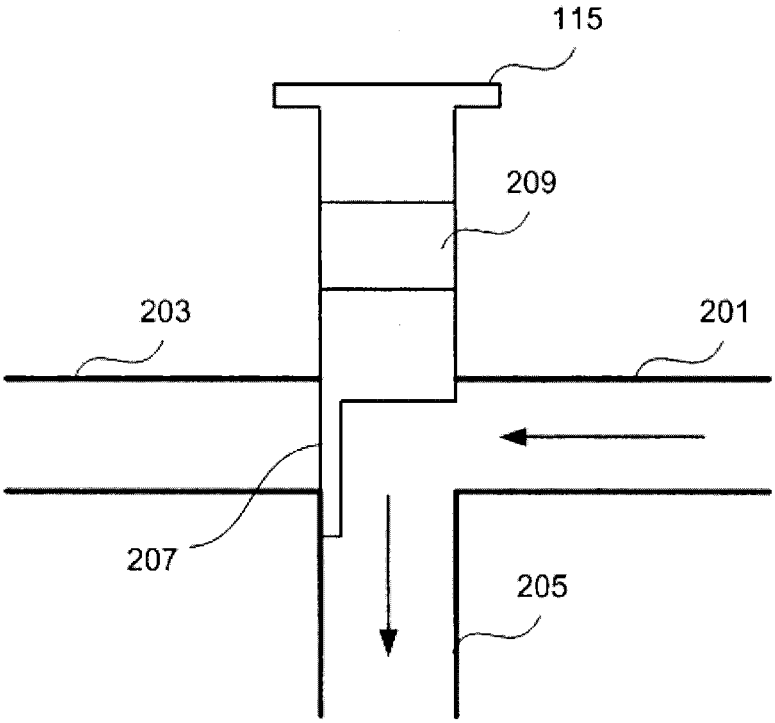
FIGS. 2A and 2B are cross sections of an embodiment of the diverter in released and pressed modes, respectively.
Figure 2B:
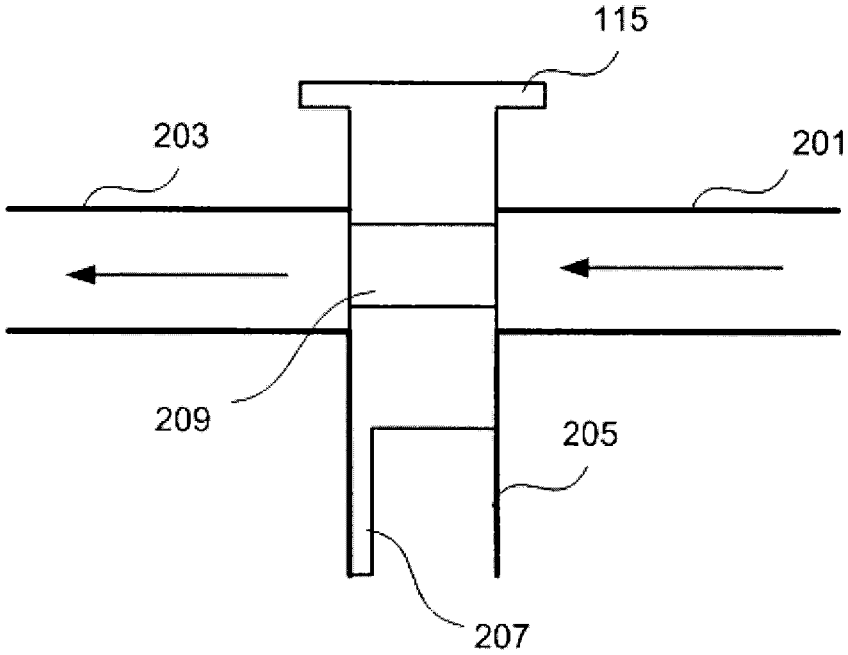

FIGS. 2A and 2B are cross sections of an embodiment of the diverter 115 in released and pressed modes, respectively. The diverter 115 includes the horizontal cavity 209 on its body, and the extended edge 207 at the bottom. When the diverter 115 is in a released state as shown in FIG. 2A, the extended edge 207 blocks the flow of water from an inlet pipe 201 to a lower basin pipe 203, and directs the flow of water to an upper basin pipe 205.

When the diverter 115 is in a pressed state as shown in FIG. 2B, the insertion of the diverter 115 into the upper basin pipe 205 blocks the flow of water from the inlet pipe 201 to the upper basin pipe 205. Also, when the diverter 115 is in the pressed state, the horizontal cavity 209 connects the inlet pipe 201 to the lower basin pipe 203, thereby allowing the flow of water from the inlet pipe 201 to the lower basin pipe 203. As a result, the flow of water is diverted to the lower basin pipe 203.

If the horizontal cavity 209 is spaced closely to the extended edge 207, water may be directed to the lower basin pipe 203 and the upper basin pipe 205 simultaneously.

The diverter may be mounted anywhere on the upper basin 101, on the lower basin 103, or on/in the stand 105. Alternatively, the diverter 115 may be mounted outside the bathroom sink, e.g., on a wall adjacent to the bathroom sink.

Figure 3:
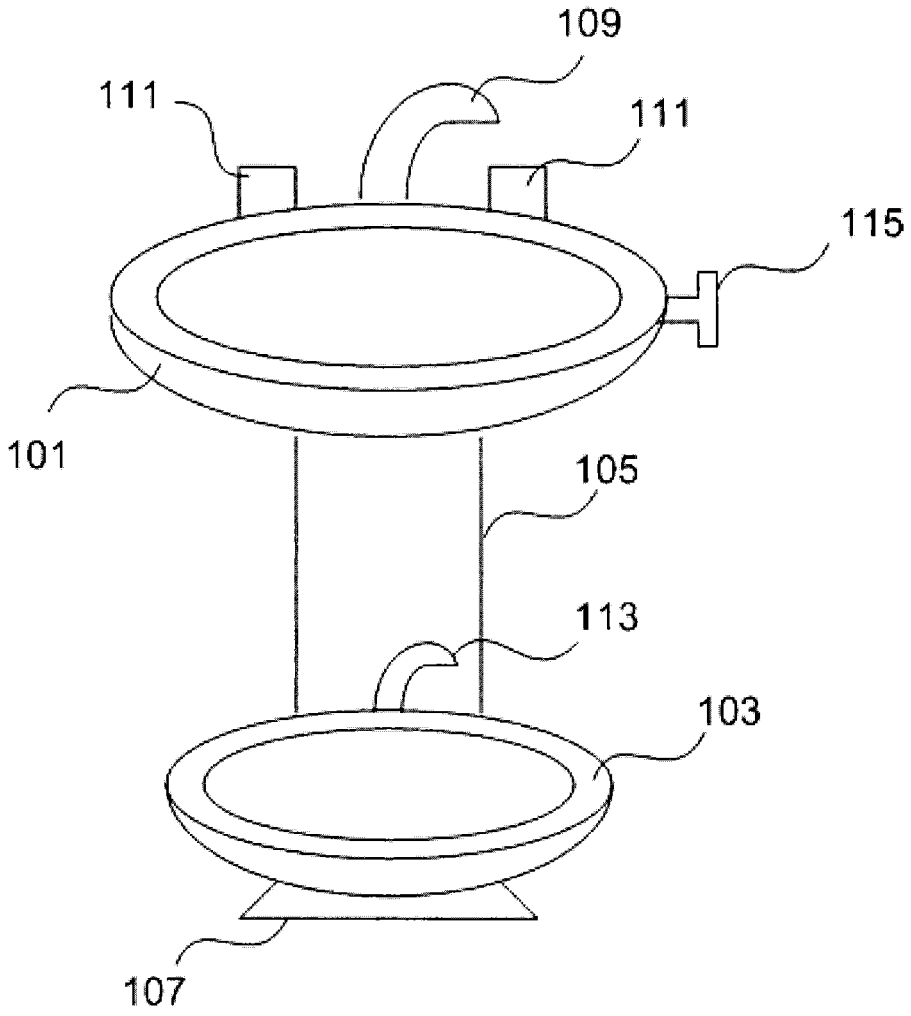
FIG. 3 is an illustrative view of an embodiment of a bathroom sink with an upper and a lower basin, and a diverter mounted on the side of the upper basin.

FIG. 3 is an illustrative view of a bathroom sink with an upper basin 101, a lower basin 103, and a diverter 115 mounted on the side of the upper basin 101.

Figure 4:
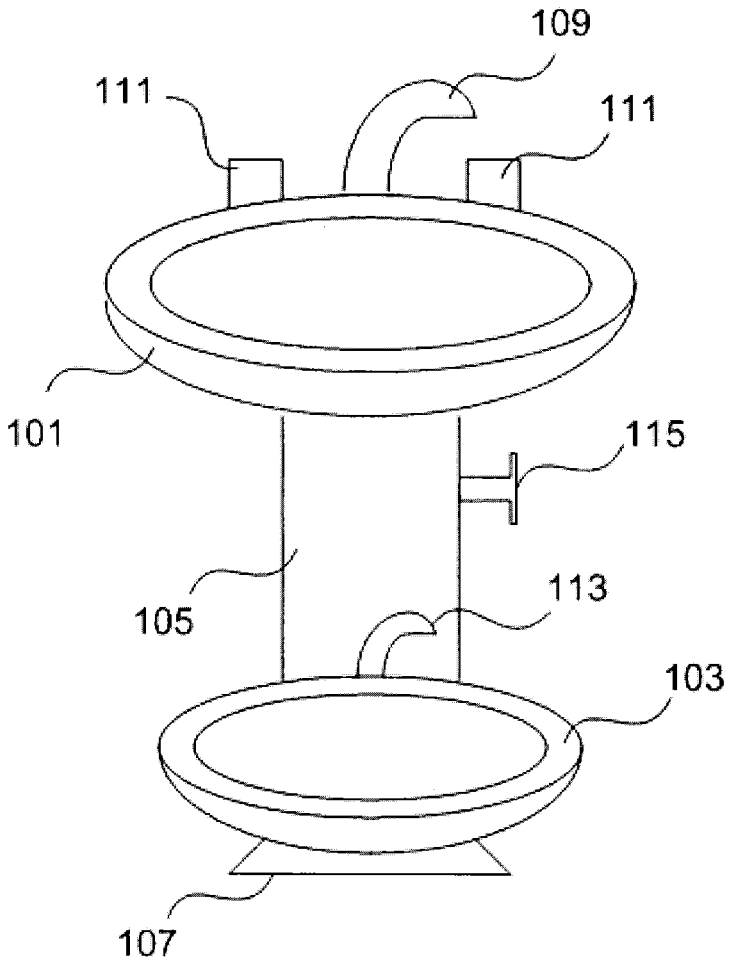
FIG. 4 is an illustrative view of an embodiment of a bathroom sink with an upper and a lower basin, and a diverter mounted at knee level on a stand connecting the upper basin to the lower basin.

FIG. 4 is an illustrative view of a bathroom sink with an upper basin 101, a lower basin 103, and a diverter 115 mounted at knee level on the stand 105 connecting the upper basin 101 to the lower basin 103. The diverter 115 may alternatively be mounted at foot or any other level on the stand 105.

Figure 5:
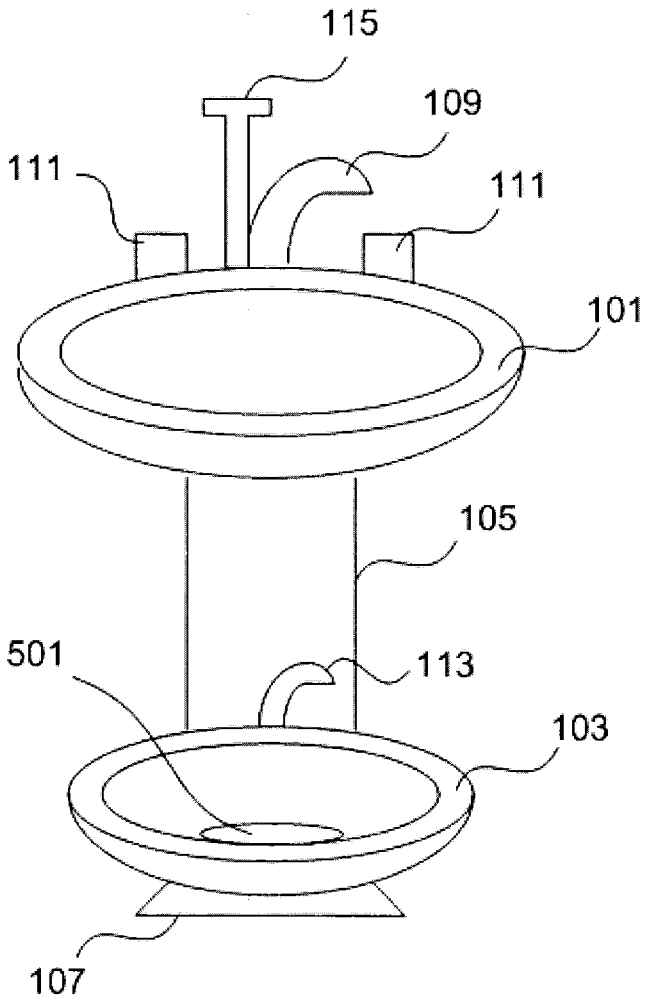
FIG. 5 is an illustrative view of an embodiment of a bathroom sink with an upper and a lower basin, where the lower basin has two faucets mounted theron on opposite sides of the lower basin.

FIG. 5 is an illustrative view of an embodiment of a bathroom sink with an upper basin 101, a lower basin 103, a first faucet 109 mounted on the upper basin 101, a second faucet 113 mounted on the lower basin 103, and a third faucet 501 mounted on the lower basin 103. The third faucet 501 is mounted opposite to the second faucet 113, and water is directed upward toward the second faucet 113 so as to wash the bottoms of a person's feet. The third faucet 501 may be U-shaped so the users may rest their foot within the third faucet 501 at the time of washing their foot. Alternatively, the third faucet 501 may be an inverted faucet or a sprinkler.

The combination of the flow of water from the second faucet 113 and the third faucet 501 makes it possible to wash the feet and ankles more easily and thoroughly within the lower basin 103. A user may need to thoroughly wash their feet and ankles for, e.g., the Wudu process. Wudu is a process of preparation for Muslim prayers. The Wudu process includes several steps, including the steps of washing hands and feet in a particular manner and order.

Alternatively or additionally, one or more additional faucets may be mounted around the inner sides of the lower basin 103. The additional faucets may be holes around the inner wall of the lower basin 103.

Figure 6:
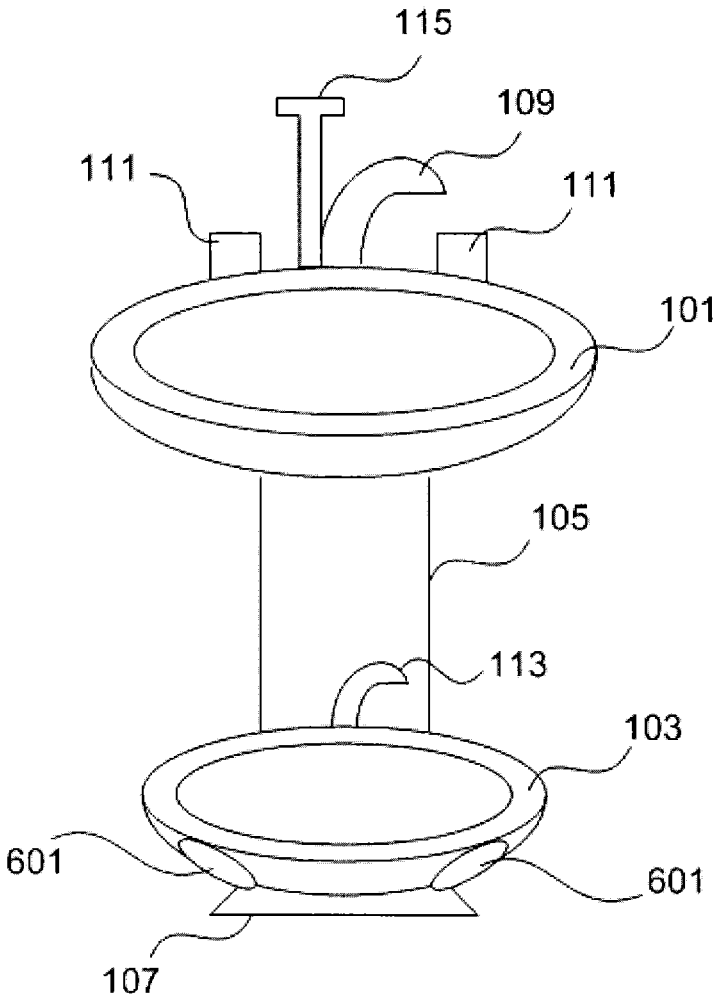
FIG. 6 is an illustrative view of an embodiment of a bathroom sink with an upper and a lower basin, and two driers mounted on the sides of the lower basin.

FIG. 6 is an illustrative view of a bathroom sink with an upper basin 101, a lower basin 103, and a pair of driers 601 mounted on the sides of the lower basin 103. The driers 601 may be used to dry a user's feet after washing them. The driers 601 may be operated via a motion sensor, a switch, or a pedal.

Alternatively, a single drier may be mounted in the middle of the outer surface of the lower basin 103.

Figure 7:
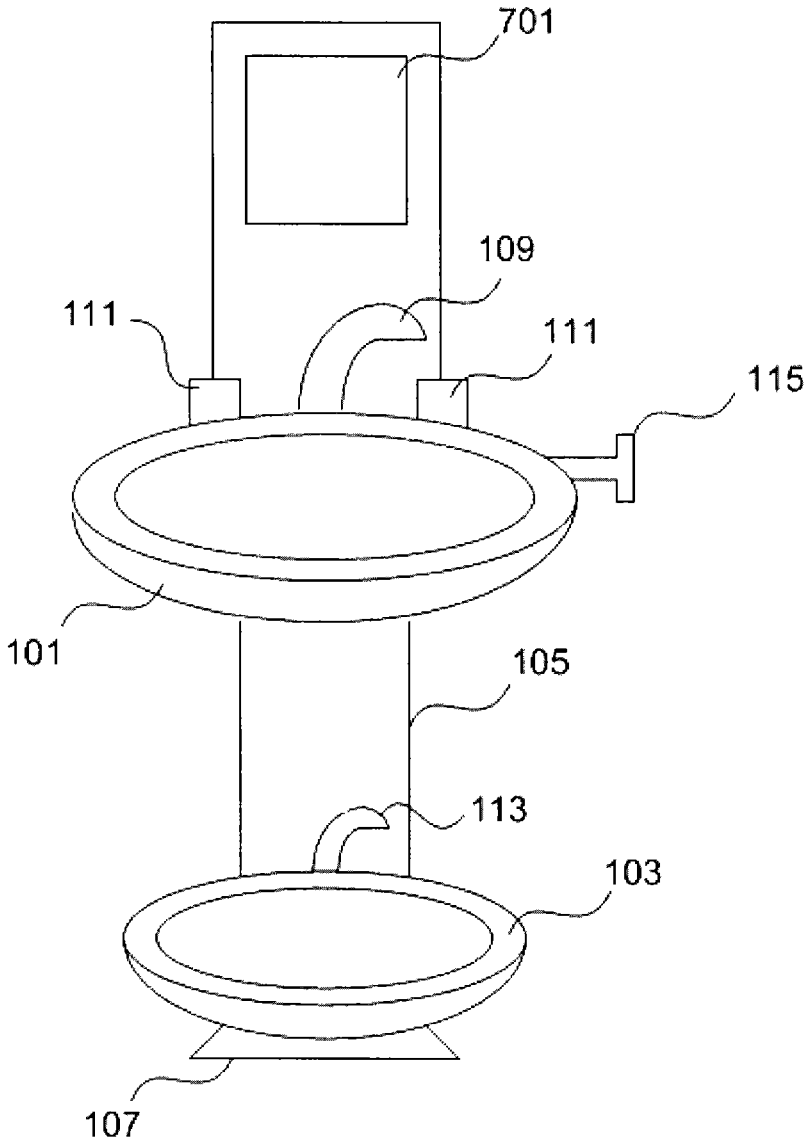
FIG. 7 is an illustrative view of an embodiment of a bathroom sink with an upper and a lower basin, and a display panel mounted on the upper basin.

FIG. 7 is an illustrative view of a bathroom sink with an upper basin 101, a lower basin 103, and a control panel 701 mounted on the upper basin 101. The control panel 701 may be used to show instructional information to a user, such as step by step instructions for the Wudu process, or other information. The control panel may also be used to control the flow of water, based on a timer or a water meter. The control panel may further be used to input a user ID of a user, and log water usage or other information in association with the user ID, in a permanent memory.

Figure 8:
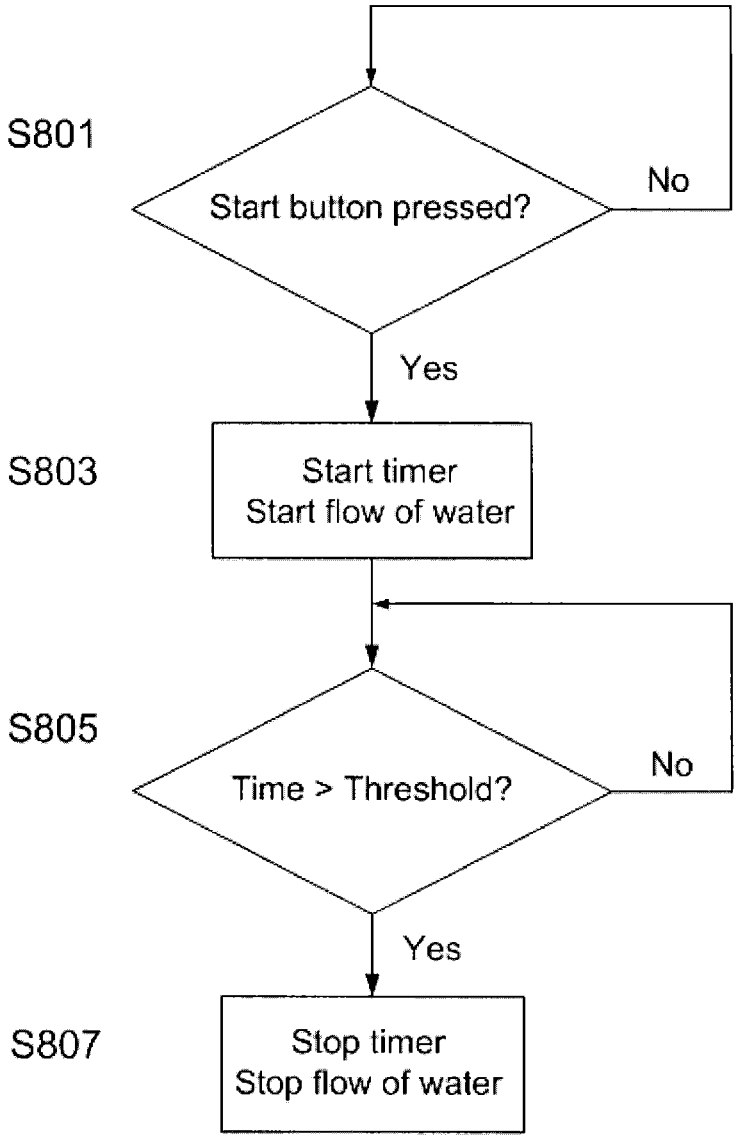
FIG. 8 is a flowchart for controlling a flow of water based on a timer.

FIG. 8 is a flowchart for controlling the flow of water based on a timer.

In step S801, the process checks if a start button has been pressed, indicating the initiation of the timing process. If the start button is not pressed, the process loops back to step S801. Otherwise, the process proceeds to step S803.

In step S803, the timer is started. Also, in this step, the flow of water is started.

In step S805, the process checks if a reading of the timer has exceeded a predetermined threshold. If the reading of the timer has not exceeded the predetermined threshold, the process loops back to step S805. Otherwise, the process proceeds to step S807.

In step S807, the timer and the flow of water are stopped.

According to another embodiment, the flow of water may be manually controlled by the user, and the reading of the timer may be provided to the user without automatically controlling the flow of water based on the reading of the timer.

Figure 9:
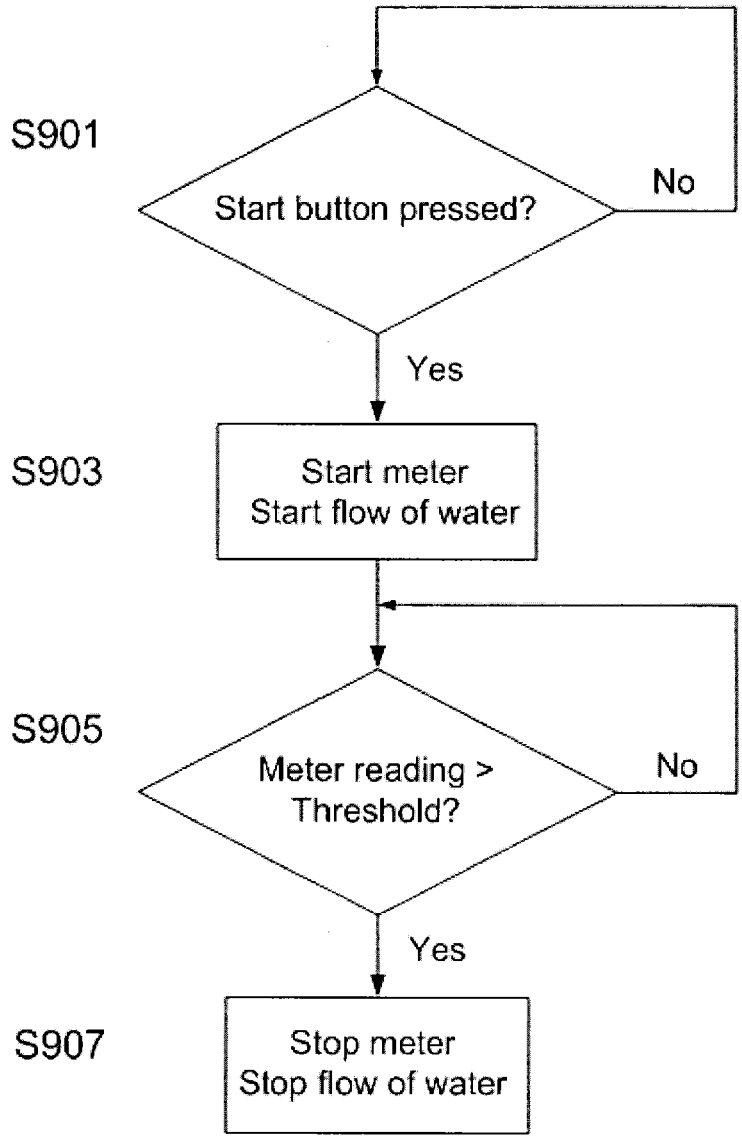
FIG. 9 is a flowchart for operating a water meter.

FIG. 9 is a flowchart for operating a water meter.

In step S901, the process checks if a start button has been pressed, indicating the initiation of the process. If the start button is not pressed, the process loops back to step S901. Otherwise, the process proceeds to step S903.

In step S903, the water meter is started. Also, in this step, the flow of water is started.

In step S905, the process checks if a reading of the water meter has exceeded a predetermined threshold. If the reading of the water meter has not exceeded the predetermined threshold, the process loops back to step S905. Otherwise, the process proceeds to step S907.

In step S907, the water meter and the flow of water are stopped.

According to another embodiment, the flow of water may be manually controlled by the user, and the reading of the water meter may be provided to the user without automatically controlling the flow of water based on the reading of the water meter.

Figure 10:
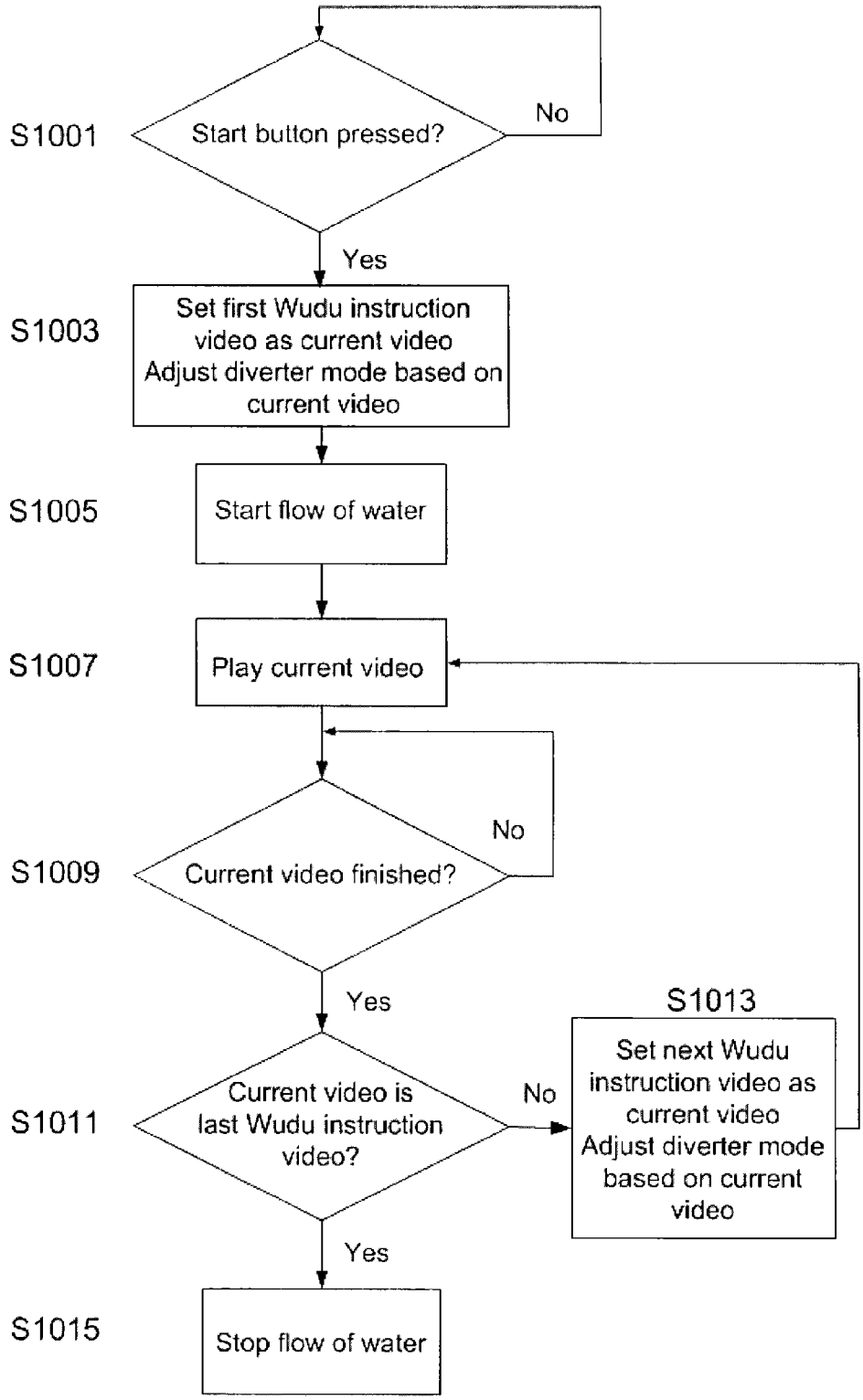
FIG. 10 is a flowchart for a process of providing Wudu instructions.

FIG. 10 is a flowchart for providing Wudu instructions to a user. According to an embodiment, Wudu instructions may be stored in a permanent memory as a sequence of Wudu instruction videos corresponding to different steps of the Wudu process. A corresponding mode of operation of the diverter 115 may also be stored in the permanent memory, in association with the Wudu instruction videos, and based on the water flow requirements relating to the Wudu instruction videos. Such mode of operation of the diverter 115 may be used to control the diverter 115 at the time a particular Wudu instruction video is provided to the user.

In step S1001, the process checks if a start button has been pressed, indicating the initiation of the Wudu process. If the start button is not pressed, the process loops back to step S1001. Otherwise, the process proceeds to step S1003.

In step S1003, a first Wudu instruction video is set as the current video, and the mode of the diverter 115 is adjusted according to the water flow requirements of the current video.

In step S1005, the flow of water is started.

In step S1007, the current video is started and displayed on the control panel 701.

In step S1009, the process checks if the current video has finished. If the current video has not finished, the process loops back to step S1009. Otherwise, the process proceeds to step S1011.

In step S1011, the process checks if the current video is the last Wudu instruction video. If the current video is not the last Wudu instruction video, the process proceeds to step S1013. Otherwise, the process proceeds to step S1015.

If the process proceeds to step S1013, the next Wudu instruction video is set as the current video, the diverter 115 is adjusted according to the water flow requirements of the current video, and the process loops back to step S1007.

If the process proceeds to step S1015, the flow of water is stopped.

According to another embodiment, the diverter 115 and/or the flow of water may be manually controlled by the user, and the Wudu instruction videos may be provided to the user without automatically controlling the mode of the diverter 115 and/or the flow of water.

According to another embodiment, the user may choose a manual or an automatic mode of controlling the diverter 115 before starting the Wudu instruction videos.

According to another embodiment, the user may choose a manual or an automatic mode of controlling the flow of water before starting the Wudu instruction videos.

According to another embodiment, the user may pause or skip the currently playing Wudu instruction video before the video is finished.

According to another embodiment, audio Wudu instructions may be provided instead of video instructions.

According to another embodiment, an audible and/or visual indicator may be provided to inform the user when the mode of the diverter 115 is changed.

According to another embodiment, the user may disable the automatic control of the mode of the diverter 115 via a diverter disable switch.

Figure 11:
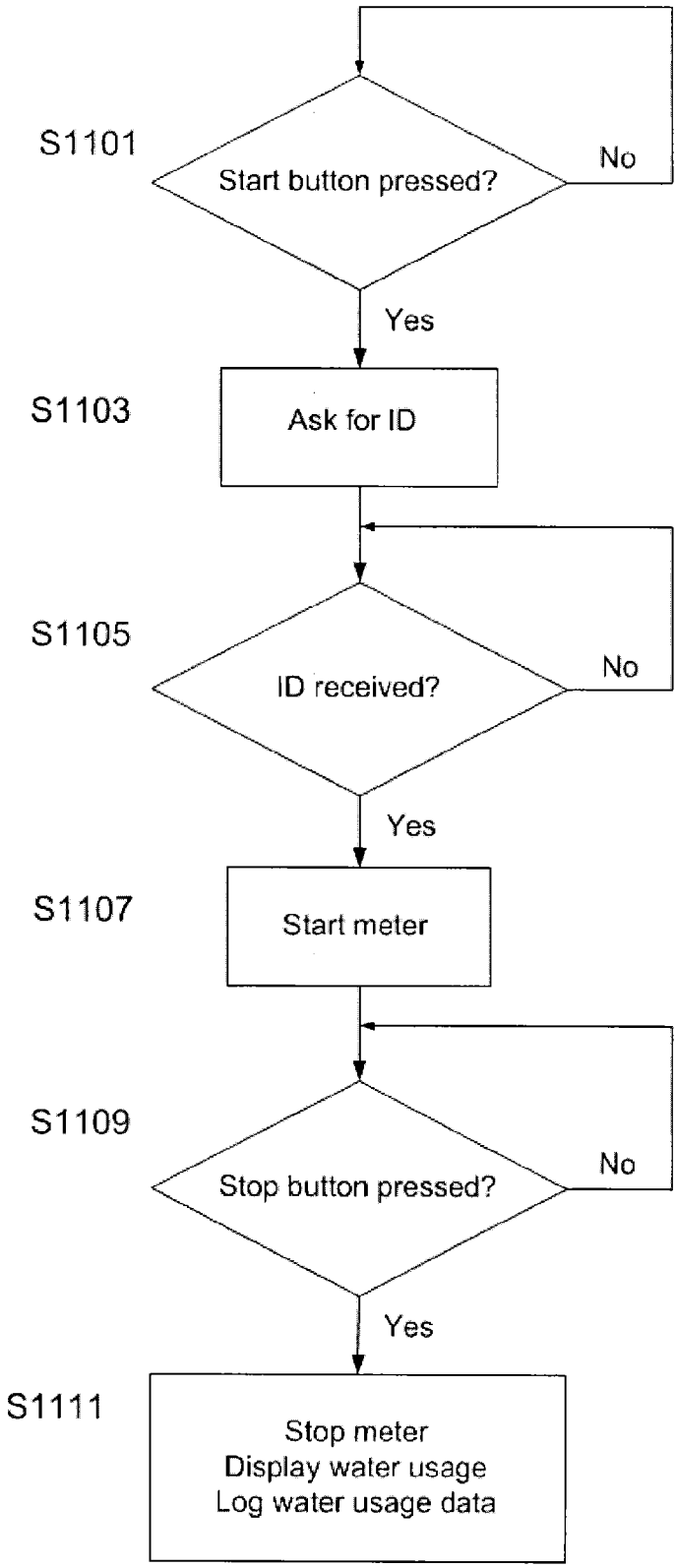
FIG. 11 is a flowchart for operating a water meter, and for logging the corresponding meter reading information in association with a user ID.

FIG. 11 is a flowchart for operating a water meter, and for logging the corresponding meter reading information in a permanent memory and in association with a user ID provided by a user.

In step S1101, the process checks if a start button has been pressed, indicating the initiation of the process. If the start button is not pressed, the process loops back to step S1101. Otherwise, the process proceeds to step S1103.

In step S1103, the process instructs the user to provide a user ID via the control panel 701.

In step S1105, the process checks if a user ID has been received via the control panel 701. If a user ID has not been received, the process loops back to step S1105. Otherwise, the process proceeds to step S1107.

In step S1107, a water meter is started.

In step S1109, the process checks if a stop button has been pressed, indicating the end of the process. If the stop button is not pressed, the process loops back to step S1109. Otherwise, the process proceeds to step S1111.

In step S1111, the water meter is stopped, and the water usage is displayed on the control panel 701. Also, in this step, the water usage is logged in a permanent memory and in association with the user ID.

According to an embodiment, a report of the previously logged water usage information may be provided to the user before or after the logging process.

According to an embodiment, a report and comparison of the previously logged and currently logged water usage information may be provided to the user after the logging process.

Figure 12:
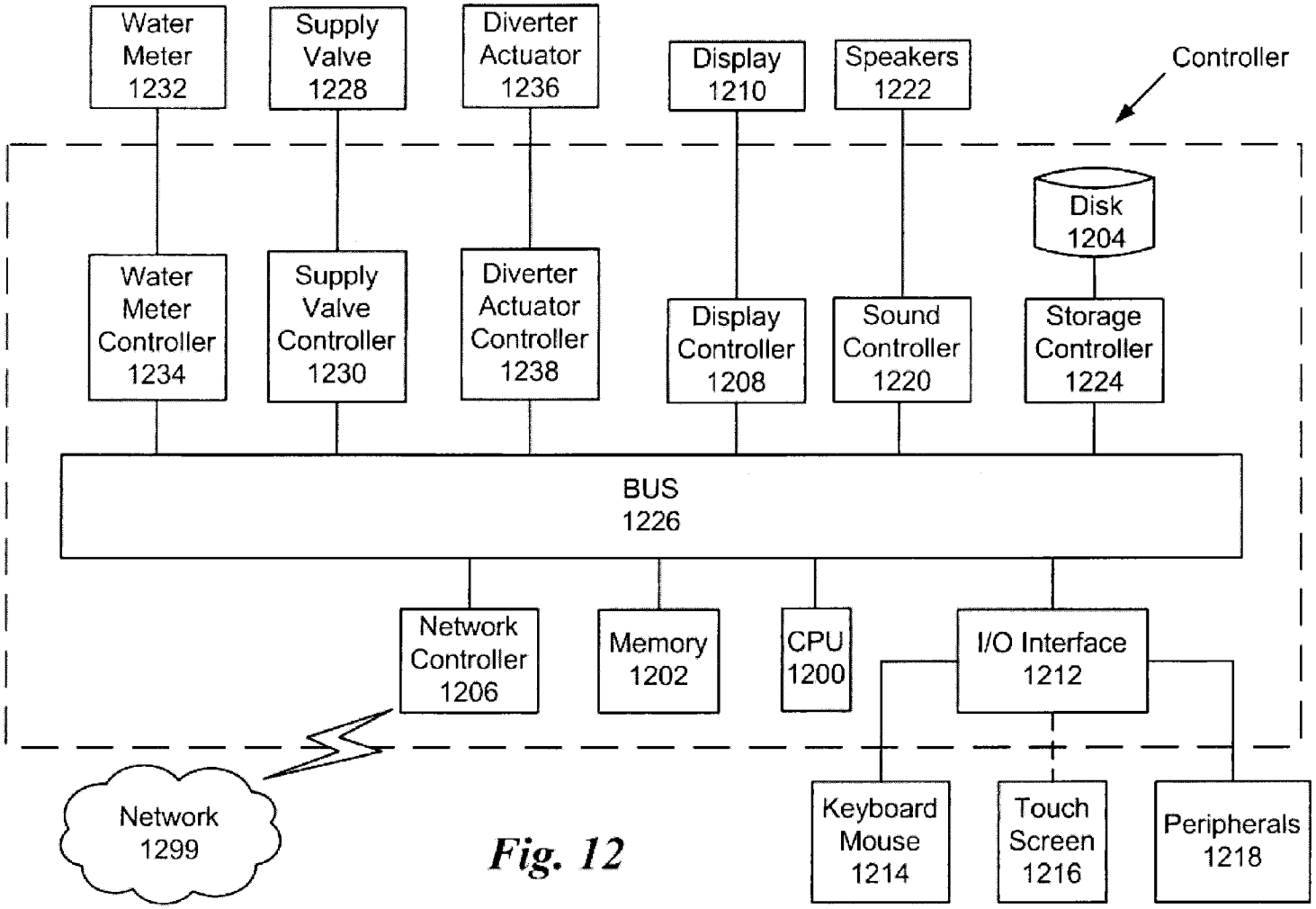
FIG. 12 is a block diagram of a computer.

FIG. 12 is a block diagram of a controller which may be used to perform the above-described processes. A hardware description of the controller according to exemplary embodiments is described with reference to FIG. 12. In FIG. 12, the controller includes a CPU 1200 which performs the processes described above. The process data and instructions may be stored in memory 1202. These processes and instructions may also be stored on a storage medium disk 1204 such as a hard drive (HDD) or portable storage medium or may be stored remotely. Further, the claimed advancements are not limited by the form of the computer-readable media on which the instructions of the inventive process are stored. For example, the instructions may be stored on CDs, DVDs, in FLASH memory, RAM, ROM, PROM, EPROM, EEPROM, hard disk or any other information processing device with which the controller communicates, such as a server or computer.

Further, the claimed advancements may be provided as a utility application, background daemon, or component of an operating system, or combination thereof, executing in conjunction with CPU 1200 and an operating system such as Microsoft Windows 7, UNIX, Solaris, LINUX, Apple MAC-OS and other systems known to those skilled in the art.

CPU 1200 may be a Xenon or Core processor from Intel of America or an Opteron processor from AMD of America, or may be other processor types that would be recognized by one of ordinary skill in the art. Alternatively, the CPU 1200 may be implemented on an FPGA, ASIC, PLD or using discrete logic circuits, as one of ordinary skill in the art would recognize. Further, CPU 1200 may be implemented as multiple processors cooperatively working in parallel to perform the instructions of the inventive processes described above.

The controller in FIG. 12 also includes a network controller 1206, such as an Intel Ethernet PRO network interface card from Intel Corporation of America, for interfacing with network 1299. As can be appreciated, the network 1299 can be a public network, such as the Internet, or a private network such as a LAN or WAN network, or any combination thereof and can also include PSTN or ISDN sub-networks. The network 1299 can also be wired, such as an Ethernet network, or can be wireless such as a cellular network including EDGE, 3G and 4G wireless cellular systems. The wireless network can also be WiFi, Bluetooth, or any other wireless form of communication that is known.

The controller further includes a display controller 1208, such as a NVIDIA GeForce GTX or Quadro graphics adaptor from NVIDIA Corporation of America for interfacing with display 1210, such as a Hewlett Packard HPL2445w LCD monitor. A general purpose I/O interface 1212 interfaces with a keyboard and/or mouse 1214 as well as a touch screen panel 1216 on or separate from display 1210. General purpose I/O interface also connects to a variety of peripherals 1218 including printers and scanners, such as an OfficeJet or DeskJet from Hewlett Packard.

A sound controller 1220 is also provided in the controller, such as Sound Blaster X-Fi Titanium from Creative, to interface with speakers/microphone 1222 thereby providing sounds and/or music. The speakers/microphone 1222 can also be used to accept dictated words as commands for controlling the controller or for providing location and/or property information with respect to the target property. The speakers/microphone 1222 may be used in the process of providing Wudu instructions, water usage measurement information, or other information to the user.

The general purpose storage controller 1224 connects the storage medium disk 1204 with communication bus 1226, which may be an ISA, EISA, VESA, PCI, or similar, for interconnecting all of the components of the controller. A description of the general features and functionality of the display 1210, keyboard and/or mouse 1214, as well as the display controller 1208, storage controller 1224, network controller 1206, sound controller 1220, and general purpose I/O interface 1212 is omitted herein for brevity as these features are known.

A water meter controller 1234 is also provided in the controller, to interface with a water meter 1232, so a measurement of the flow of water may be controlled, displayed and/or recorded via the controller.

A supply valve controller 1230 is also provided in the controller, to interface with a supply valve 1228, so the flow of water may be controlled via the controller.

A diverter actuator controller 1238 is also provided in the controller, to interface with a diverter actuator 1236, so the diverter actuator 1236 may be controlled via the controller to force the diverter 115 into a pressed or a released mode.

According to an embodiment, the mode of the diverter 115 may be controlled by the user via a soft button on the touch screen 1216.

According to another embodiment, the mode of the diverter 115 may be controlled by the user via a switch on the control panel 107.

The display 1210, the speakers 1222, the keyboard/mouse 1214, the touch screen 1216, and the peripherals 1218, may be included in the control panel 701.

Thus, the foregoing discussion discloses and describes merely exemplary embodiments of the present invention. As will be understood by those skilled in the art, the present invention may be embodied in other specific forms without departing from the spirit or essential characteristics thereof. Accordingly, the disclosure of the present invention is intended to be illustrative, but not limiting of the scope of the invention, as well as other claims. The disclosure, including any readily discernible variants of the teachings herein, define, in part, the scope of the foregoing claim terminology such that no inventive subject matter is dedicated to the public.

The invention claimed is:

1. A bathroom fixture comprising:

an upper basin and a lower basin;

the upper basin including a first faucet and a pair of water control valves mounted to the upper basin that control a flow of water into the upper basin and the lower basin via an inlet pipe;

the lower basin disposed under the upper basin and including a second faucet mounted to the lower basin, the lower basin occupying a substantially equal or smaller footprint as the upper basin;

a pedestal stand that separates the upper basin from the lower basin, said pedestal stand having an upper portion that supports the upper basin, and a support portion that rests on a support surface and supports a weight of the bathroom fixture, a center portion of the pedestal standing including a hollow portion, said pedestal stand holds the lower basin at an elevated position above the support surface;

an upper basin pipe disposed in the hollow portion of the pedestal stand that is coupled to the inlet pipe;

a lower basis pipe disposed in the hollow portion of the pedestal stand that is coupled to the inlet pipe;

a diverter having an elongated shape that defines an elongated axis therein and is disposed between the inlet pipe and the upper basin pipe and also disposed between the inlet pipe and the lower basin pipe, the diverter having a controllable end that extends from the upper basin so as be grasped by an operator when changing between a released mode and a pressed mode by axially moving the diverter along the elongated axis, and an extended edge that is opposite the controllable end, the diverter including a horizontal cavity between the controllable end and the extended edge, wherein when the diverter is positioned in the released mode, a flow of water is directed to the first faucet through the horizontal cavity and another portion of the diverter blocks water from entering the lower basin pipe, and when the diverter is positioned in the pressed mode, a flow of water is directed to the second faucet by the extended edge and a blocking portion of the diverter blocks water from entering the upper basin pipe.

2. The bathroom fixture of claim 1, wherein the diverter is mounted next to the first faucet, on a top side of the upper basin.

3. The bathroom fixture of claim 1, further comprising:

one or more additional faucets mounted to the lower basin.

4. The bathroom fixture of claim 3, wherein the one or more additional faucets includes one or more of a U-shaped faucet, a hole mounted around an inner wall of the lower basin, an inverted faucet, or an sprinkler.

5. The bathroom fixture of claim 3, wherein at least one of the one or more additional faucets is mounted opposite to the second faucet.

6. The bathroom fixture of claim 1, further comprising:

one or more driers mounted to the lower basin.

7. The bathroom fixture of claim 1, wherein the stand includes a hollow portion in which water is conveyed to the lower basin when the diverted is in the pressed mode.

* * * * *